US010674760B2

(12) United States Patent
Dowling

(10) Patent No.: US 10,674,760 B2
(45) Date of Patent: Jun. 9, 2020

(54) DEVICE FOR HOLDING A CIGAR

(71) Applicant: Frank Dowling, West Palm Beach, FL (US)

(72) Inventor: Frank Dowling, West Palm Beach, FL (US)

( * ) Notice: Subject to any disclaimer, the term of this patent is extended or adjusted under 35 U.S.C. 154(b) by 441 days.

(21) Appl. No.: 15/341,589

(22) Filed: Nov. 2, 2016

(65) Prior Publication Data

US 2017/0143036 A1 May 25, 2017

Related U.S. Application Data

(60) Provisional application No. 62/249,580, filed on Nov. 2, 2015.

(51) Int. Cl.
*A24F 13/14* (2006.01)

(52) U.S. Cl.
CPC ..... *A24F 13/14* (2013.01)

(58) Field of Classification Search
None
See application file for complete search history.

(56) References Cited

U.S. PATENT DOCUMENTS

| | | | | |
|---|---|---|---|---|
| D246,803 | S | 12/1977 | Steinberg | |
| 5,868,143 | A | 2/1999 | Nielsen | |
| 6,234,179 | B1 * | 5/2001 | Alcaraz | A24F 13/22 131/178 |
| 6,530,510 | B2 | 3/2003 | Ferrari | |
| 2004/0023733 | A1 * | 2/2004 | Tummillo | A24F 13/22 473/406 |
| 2006/0070634 | A1 | 4/2006 | Brunkow | |
| 2009/0082127 | A1 | 3/2009 | Donne | |
| 2010/0139673 | A1 * | 6/2010 | Miller | A24F 13/22 131/187 |
| 2014/0060551 | A1 | 3/2014 | Zilka | |

* cited by examiner

*Primary Examiner* — Phu H Nguyen
(74) *Attorney, Agent, or Firm* — McHale & Slavin, P.A.

(57) ABSTRACT

A cigar holder configured for use in a golf environment is disclosed. The cigar holder comprises a main body configured to receive and hold one or more cigars at one end, and to secure to a surface at an opposing second end. The main body comprises a first generally cylindrical portion and a second generally cylindrical portion orientated in a different direction as compared to the first generally cylindrical portion. The main body may comprise a bend, whereby the second portion extends away from the first portion along a different direction or plane. Positioned at a distal end is an opening. The distal end opening is sized and shaped to receive a smoking device, such as a cigar.

9 Claims, 7 Drawing Sheets

DEVICE FOR HOLDING A CIGAR

CROSS REFERENCE TO RELATED APPLICATIONS

In accordance with 37 C.F.R. 1.76, a claim of priority is included in an Application Data Sheet filed concurrently herewith. Accordingly, the present invention claims priority under 35 U.S.C. § 119(e), 120, 121, and/or 365(c) to U.S. Provisional Patent Application No. 62/249,580, entitled "DEVICE FOR HOLDING A CIGAR", filed Nov. 2, 2015. The contents of the above referenced application are incorporated herein by reference in its entirety.

FIELD OF THE INVENTION

The present invention relates to a device for holding a smoking article, such as a cigar; to a cigar holder for use in a golf environment; and more particularly, to a golf cart cigar holder.

BACKGROUND OF THE INVENTION

The game of golf has spawned a major economic industry, estimated to be a 70 billion dollar industry, with a total impact on the U.S. economy being estimated at 170 billion dollars. Many who play the game of golf attribute enjoyment of the game to the outdoor environment and camaraderie with friends. As part of the enjoyment, individuals often enjoy a cigar during the numerous rounds involved with the typical golf outing. The ability to store or hold a cigar as a golfer travels to and from various putting greens is important to the game playing experience.

SUMMARY OF THE INVENTION

The present invention describes a cigar holder for use in a golf environment. The cigar holder comprises a main body configured to receive and hold one or more cigars at a first end, and to secure to a surface at an opposing second end. The main body comprises a first portion orientated in one direction and a second portion, generally being cylindrical, orientated in a different direction, as compared to the first cylindrical portion. The main body may comprise a bend, whereby the second portion extends away from the first portion along a different direction or plane. Positioned at the first end is an opening. The first, end opening is sized and shaped to receive a smoking device or product, such as a cigar. Positioned at a second, opposing end is an engaging portion configured to secure the cigar holder to a surface, such as the ground or a golf cart tee holder. The cigar holder is designed to hold a cigar and maintain the cigar in an orientation, free from deforming or crushing, that prevents the cigar from getting wet or contaminated with pesticides or fertilizers when secured to a lawn.

Accordingly, it is an objective of the invention to provide a cigar holder for use in a golf environment.

It is a further objective of the invention to provide a golf cart cigar holder.

It is yet another objective of the invention to provide a cigar holder that can be secured to a portion of a golf cart.

It is a still further objective of the invention to provide a cigar holder that can be secured to one or more portions of a golf course.

It is a further objective of the invention to provide a cigar holder that can be secured to a portion of a golf cart and one or more portions of a golf course.

It is yet another objective of the invention to provide a cigar holder configured to hold cigars of different sizes and different ring size gauges.

It is yet another objective of the invention to provide a cigar holder configured to keep a cigar inserted therein dry.

It is yet another objective of the invention to provide a cigar holder configured to keep a cigar inserted therein free of pesticides and fertilizers.

It is yet another objective of the invention to provide a cigar holder configured to keep a cigar inserted therein free from distortion or crushing.

It is yet another objective of the invention to provide a cigar holder configured to keep a cigar inserted therein secure, clean, and lit.

Other objectives and advantages of this invention will become apparent from the following description, taken in conjunction with any accompanying drawings wherein are set forth, by way of illustration and example, certain embodiments of this invention. Any drawings contained herein constitute a part of this specification, include exemplary embodiments of the present invention, and illustrate various objects and features thereof.

DETAILED DESCRIPTION OF THE INVENTION

Figure 1:
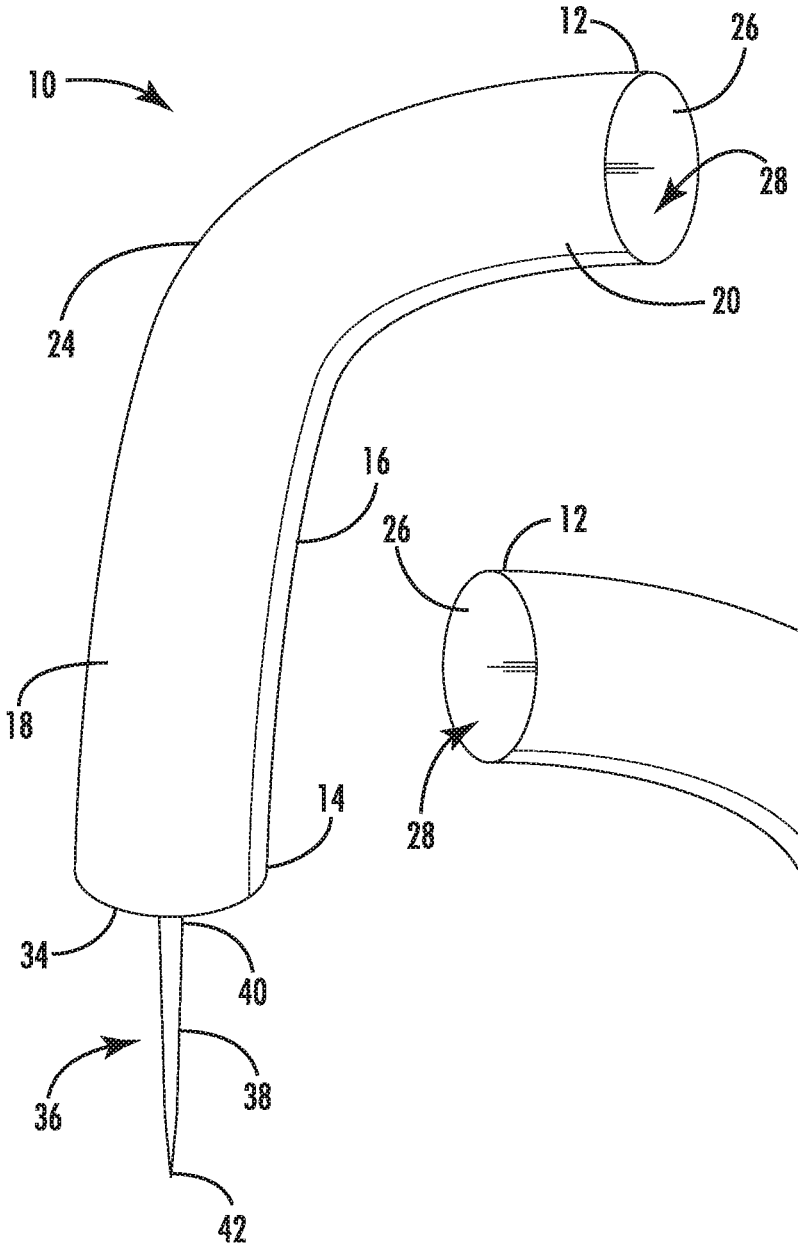
FIG. 1 is a side perspective view of an illustrative example of a cigar holder.
Figure 2:
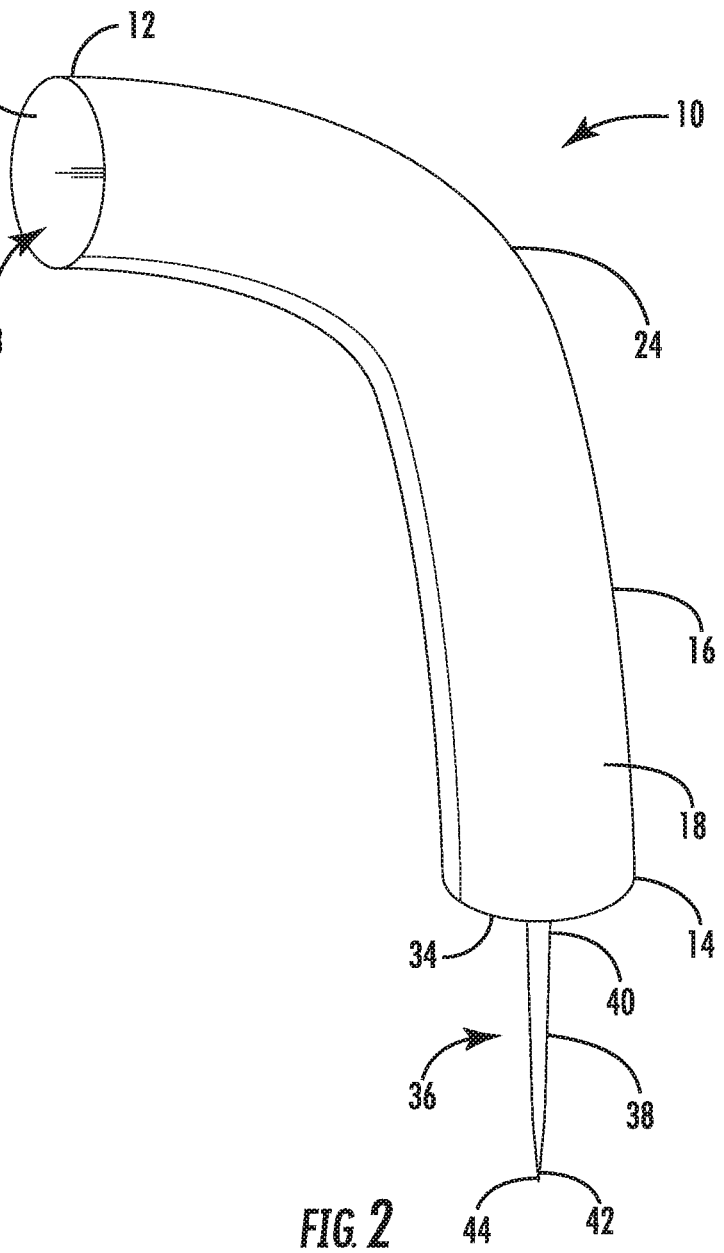
FIG. 2 is an alternative perspective view of the cigar holder.
Figure 3:
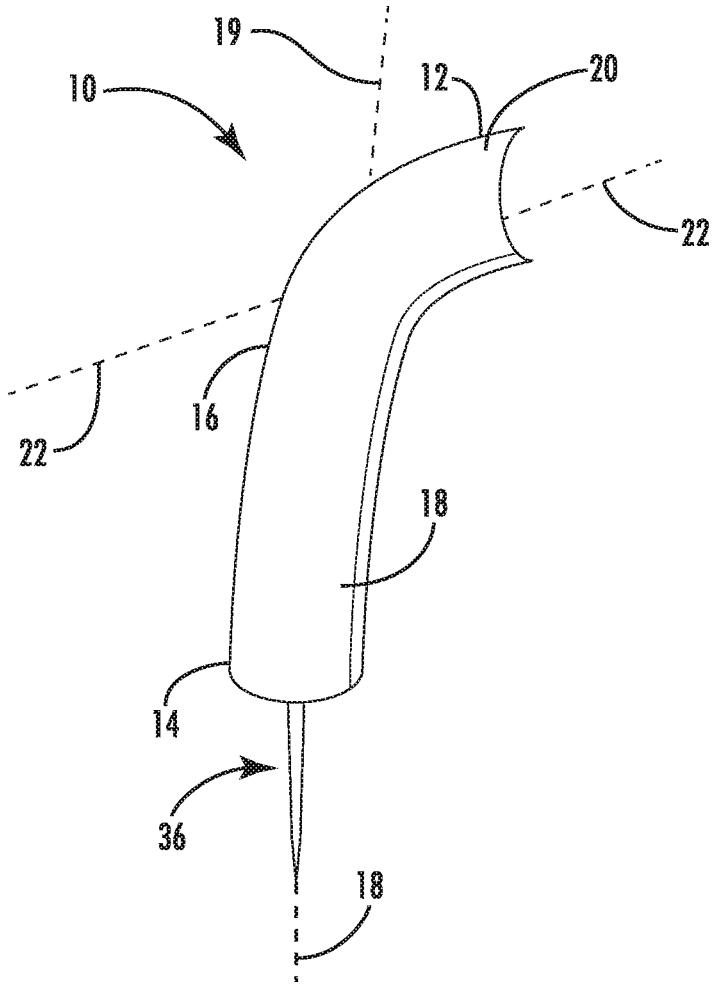
FIG. 3 is a right side view of the cigar holder.
Figure 4:
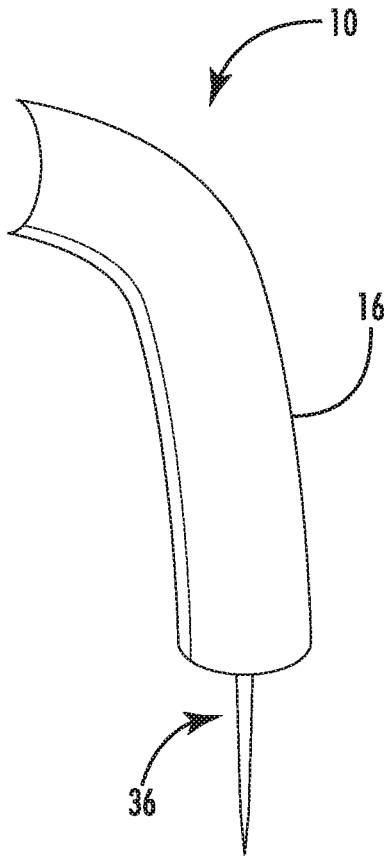
FIG. 4 is a left side view of the cigar holder.
Figure 5:
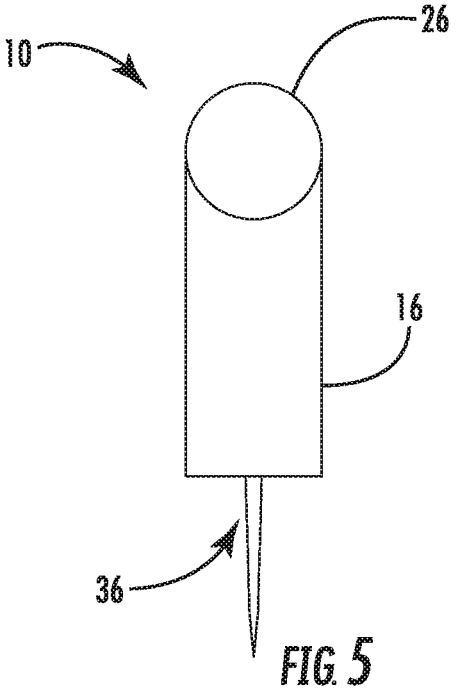
FIG. 5 is a front view of the cigar holder.
Figure 6:
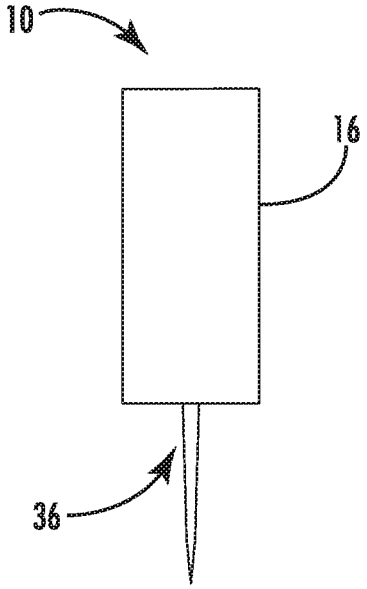
FIG. 6 is a back view of the cigar holder.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Referring to FIGS. 1-6, a device for holding a smoking article, such as a cigar, referred to generally as a cigar holder 10, is shown. The cigar holder 10 is described as configured to receive and hold a cigar, however, other smoking devices, such as cigarettes, can be used as well. The cigar holder 10 has a first end 12, a second end 14, and a main body 16 there between. The main body 16 comprises a first generally cylindrical portion 18 having a longitudinal axis 19 that defines a first longitudinal cigar holder axis, and a second generally cylindrical portion 20 having a longitudinal axis 22 that defines a second longitudinal cigar holder axis. The main body 16 comprises a bend 24, whereby the second portion 20 extends away from the first portion 18 along a different direction or plane.

Figure 7:
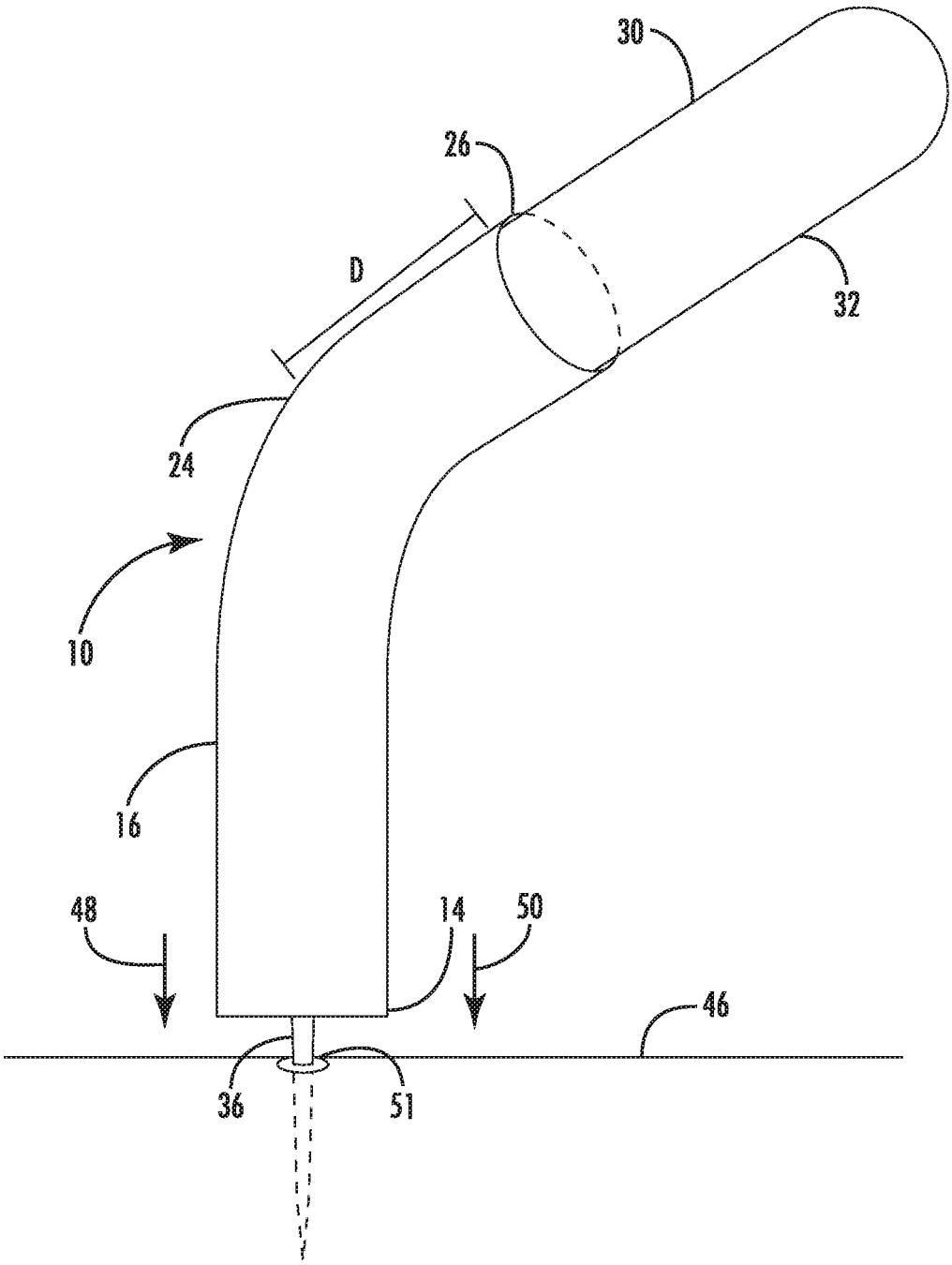
FIG. 7 is a perspective view of the cigar holder inserted into a surface.

Positioned at the first end 12 is an opening 26. The first end opening 26 is sized and shaped to receive a smoking device, such as a cigar. The opening 26 leads to a hollow, or partially hollow, interior region 28. As shown in FIG. 7, a smoking device, illustrated herein as a cigar 30, is inserted into the opening 26 so that the cigar body 32 rests within the interior region 28 of the cigar holder main body 16. The distance between the opening 26 and the bend 24, defined as distance "D", should be of a significant length to allow at least a portion of the cigar 30 to rest within the interior region 28 and 1) not fall out, or 2) not tip over the cigar holder 10.

Extending from the bottom surface 34 of the cigar holder 10 is a securing member 36. As illustrated, the securing member 36 has a smaller diameter than the diameter of the cigar holder main body 16. The securing member 36 is orientated to extend in a direction away from the second end 14. The securing member 36 is shown having an elongated body 38 having a first end 40 secured to the bottom surface 34 and a second opposing end 42. The second opposing end 42 preferably terminates in a pointed end sized and shaped to be inserted into a surface. Referring back to FIG. 7, the cigar 30 is shown inserted into the cigar holder 10 at the first end 12. The securing member 36 is shown being inserted into a surface 46 by pushing the cigar holder 10 along arrows 48 and 50. As an illustrated example, the surface 46 represents a front panel, console or dashboard associated with a golf cart which contains at least one golf tee receiving receptacle, illustrated herein as a golf tee opening 51. Since many golf carts contain a panel area having openings designed for holding golf tees, the cigar holder 10 is designed to fit into such a space. While the surface 46 is illustrated as being a golf cart panel, the surface 46 may be any surface, such as the ground or grass areas of a golf course, in which the cigar holder 10 may be inserted therein.

Figure 8:
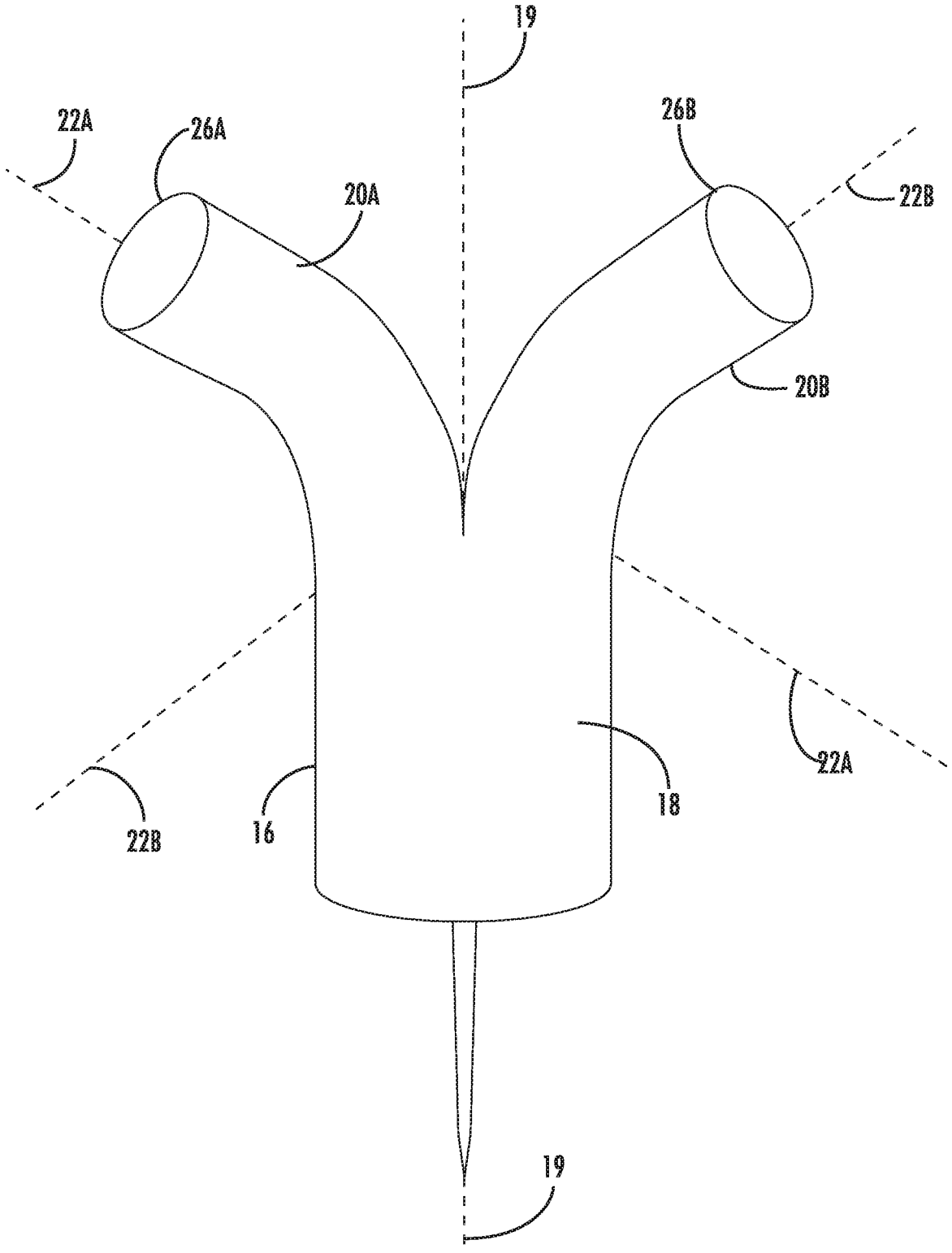
FIG. 8 illustrates a cigar holder configured to receive and hold multiple cigars.
Figure 9:
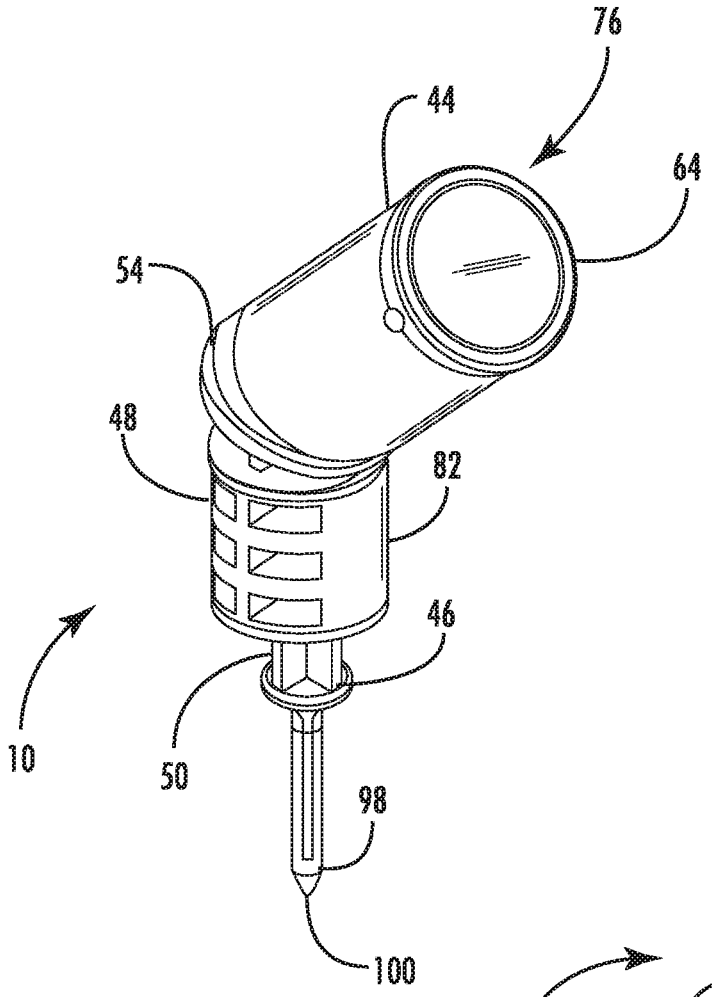
FIG. 9 is a perspective view of an alternative embodiment of the cigar holder.
Figure 10:
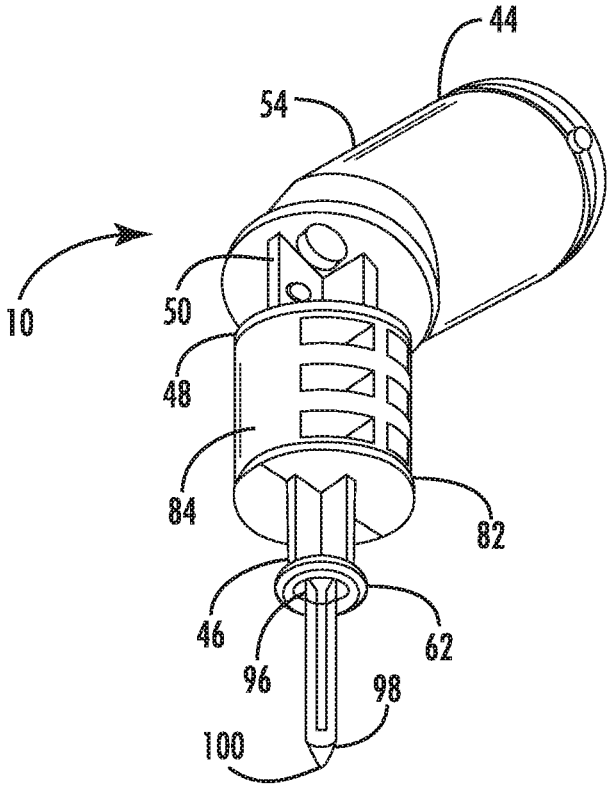
FIG. 10 is an alternative perspective view of the cigar holder illustrated in FIG. 9.
Figure 11:
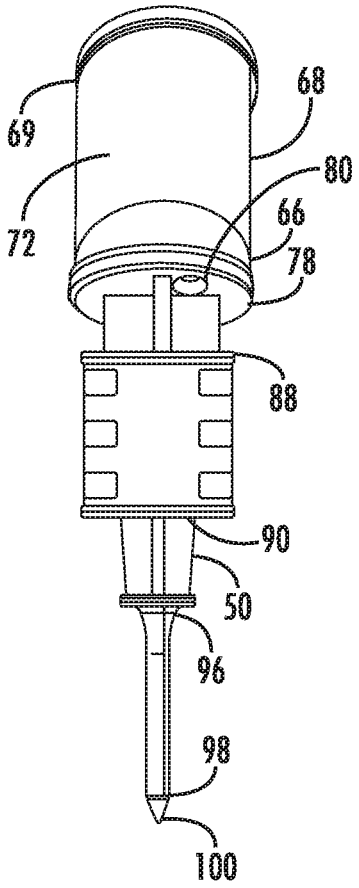
FIG. 11 is a front perspective view of the cigar holder illustrated in FIG. 9.
Figure 12:
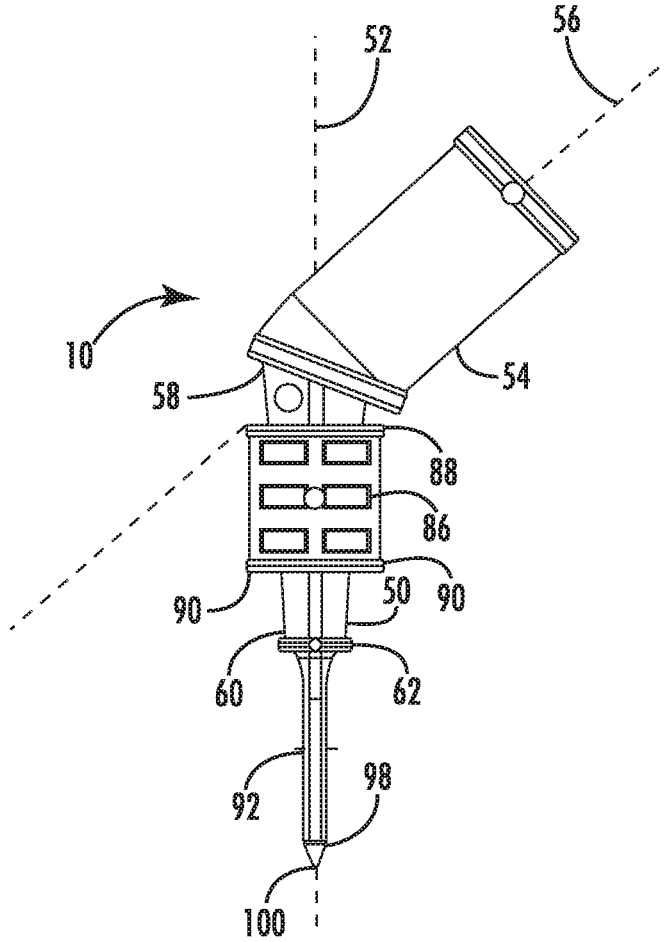
FIG. 12 is a right side view of the cigar holder illustrated in FIG. 9, the left side view being the same as the right side view.
Figure 13:
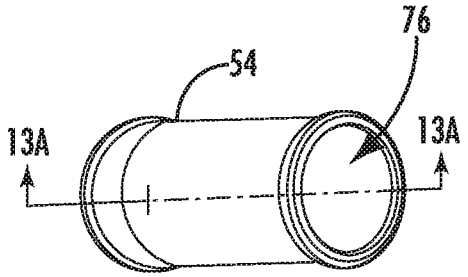
FIG. 13 is a top view of the cigar holder illustrated in FIG. 9.
Figure 14:
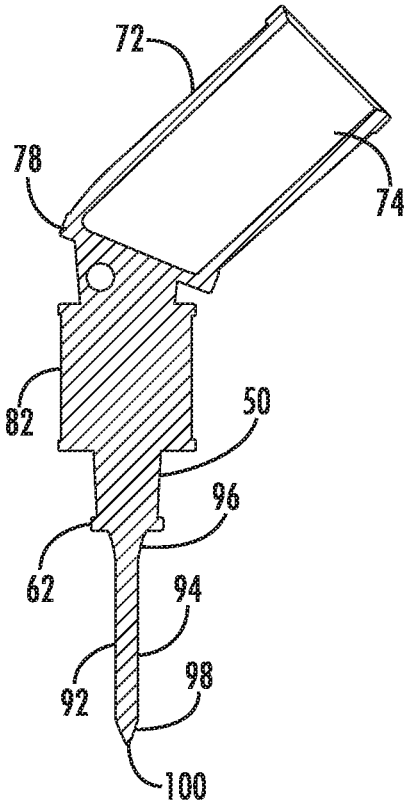
FIG. 14 is a cross sectional view of the cigar holder illustrated in FIG. 9 taken along lines 13A-13A shown in FIG. 13.

FIG. 8 illustrates the cigar holder 10 adapted to receive and hold multiple cigars. The main body 16 comprises the first generally cylindrical portion 18 having the longitudinal axis 19 that defines the first longitudinal cigar holder axis, and a plurality of second generally cylindrical portions 20A and 20B having the longitudinal axes 22A and 22B that define a second longitudinal cigar holder axis. Each of the second generally cylindrical portions 20A and 20B contain an opening, 26A and 26B respectively. A cigar may be placed in either opening 26A or 26B, or two cigars may be simultaneously stored within the cigar holder 10, one placed within opening 26A and a second cigar placed within opening 26B. Additional second generally cylindrical portions may be used in order to store more than 2 cigars.

FIGS. 9-14 illustrate an alternative embodiment of the cigar holder 10. The cigar holder 10 illustrated in FIGS. 9-14 is configured to function in the same manner as embodiments described previously. The cigar holder 10 has a first end 44, a second end 46, and a main body or first member 48 there between. The main body 48 comprises a first portion 50 having a longitudinal axis 52 that defines a first longitudinal cigar holder axis 52, and a second portion 54 having a longitudinal axis that defines a second longitudinal cigar holder axis 56. The second longitudinal cigar holder axis 56 is preferably at a different orientation or along a different plane than first longitudinal cigar holder axis 52. The first portion 50 is preferably an elongated structure or body which provides a height for the cigar holder 10. A first portion first end 58 is coupled to the second portion 54. A first portion second end 60 is positioned at a distance from the first portion first end 58. A stop member, illustrated herein as a ring 62, extends around a perimeter of the first portion 50. The ring 62 is shaped to extend outwardly away from the first portion, and is sized to contact a surface and prevent additional movement of the cigar holder 10 within the surface without additional force being applied.

The second portion 54 comprises a first end 64 and an opposing second end 66, and a second end body 68 there between. The second end body 68 comprises a continuous surface or wall 72 which encloses an interior region 74, see FIG. 14. The interior region is sized and shaped to receive one or more portions of a cigar or other smoking, tobacco related product. The second end body 68 is framed by opening 76 positioned at the first end 64 and a bottom wall or plate 78 positioned at the opposing second end 66. The bottom wall or plate 78 attaches to at least a segment of the first portion 50 at an angle so that at least a portion of the second end body 68 is aligned at an angle from the first longitudinal cigar holder axis 52.

In this manner, when a cigar or other lighted, tobacco related product is inserted into the interior region 74, the cigar is maintained at a position which is at an angle from the first longitudinal cigar holder axis 52, the surface (i.e. lawn) for which the cigar holder 10 is inserted within, or both the first longitudinal cigar holder axis 52 and the surface for which the cigar holder 10 is inserted within. The angle at which at least a segment of the first portion 50 attaches to the bottom wall or plate 78 is preferably greater than 0 degrees and less than 90 degrees. Accordingly, the angle at which the cigar is maintained relative to either the first longitudinal cigar holder axis 52 or the surface (i.e. lawn) for which the cigar holder 10 is inserted within is preferably greater than 0 degrees and less than 90 degrees. Because the cigar is maintained at an angle, ashes are prevented from being dropped back onto the rest of the cigar or within the interior region 74.

To aid in removing a portion of a cigar inserted or stuck within the interior region 74, the bottom wall or plate 78 contains an opening 80 which is sized and shaped to receive an object which, when inserted within opening 80, pushes the inserted cigar towards the second end body opening 76. As shown in FIGS. 9-14, the first portion 50 may also contain a shaped body 82 defined by a continuous surface 84. The continuous surface 84 may contain one or more slotted openings 86 and is framed by a first flanged surface 88 and a second flanged surface 90. The continuous surface 84 is sized and shaped to receive indicia, such as a sticker or other placard (not shown).

Extending from the first portion 50, preferably below the ring 62, of the cigar holder 10 is a securing member 92. As illustrated, the securing member 92 has a smaller diameter than the diameter of the first portion 50 of the cigar holder 10. The securing member 92 is orientated to extend in a direction away from the second portion 54. The securing member 92 is shown having an elongated body 94 having a first end 96 secured to the first portion 50 and a second opposing end 98. The second opposing end 98 preferably terminates in a pointed end 100 sized and shaped to be inserted into a surface. Similar to the cigar holder 10 illustrated in FIG. 7, the securing member 92 may be inserted into a surface, such as a front panel, console or dashboard associated with a golf cart which contains at least one golf tee receiving receptacle, or the ground or grass areas of a golf course. Once in position, a cigar or other tobacco related product can be inserted and secured within at least a segment of the second portion 54.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A device for holding a smoking product comprising:

a main body configured to secure and maintain a smoking product at an angle from a surface in which said main body is secured thereto, said main body has a first elongated portion configured to provide a height and a longitudinal axis that defines first longitudinal smoking product holder axis, and a second portion having a longitudinal axis that defines a second longitudinal smoking product axis, said second portion having a bottom wall, a top open end, and a continuous side wall which extends from said bottom wall to said top open end, said continuous side wall extending around and fully enclosing said bottom wall to form an interior region, said second portion interior region is configured to receive and hold at least a portion of said smoking product therein, said second portion interior region extends away from said first longitudinal smoking product holder axis and is orientated in a position whereby said first longitudinal smoking product holder axis intersects with said second longitudinal smoking product holder axis at an angle greater than 0 degrees and less than 90 degrees, wherein when said smoking product is inserted into said second portion, said smoking product is maintained above said source secured thereto and at an angle greater than ii degrees and less than 90 degrees from said first longitudinal smoking product holder axis and said surface; and a securing member configured to secure said main body to said surface; wherein said securing member has an elongated body having a first end extending from said main body first portion, and a second opposing end terminates in a pointed end sized and shaped to be inserted into an opening which fits a golf tee.

2. The device for holding a smoking product according to claim 1 further including a stop member.

3. The device for holding a smoking product according to claim 2 wherein said stop member extends around a perimeter of said main body first portion.

4. The device for holding a smoking product according to claim 1 wherein said securing member second opposing end terminates in a pointed end sized and shaped to be inserted into a surface.

5. The device for holding a smoking product according to claim 1 wherein said securing member has a smaller diameter than the diameter of said main body.

6. The device for holding a smoking product according to claim 1 wherein said second portion bottom wall contains a bottom wall opening, said bottom wall opening sized and shaped to receive an object.

7. The device for holding smoking product according to claim 1 wherein said surface is grass or ground.

8. The device for holding smoking product according claim 1 wherein said securing member is sized and shaped to fit within a golf cart panel golf tee opening.

9. A device for holding a smoking product comprising:

a main body configured to secure and maintain a smoking product at an angle from a surface in which said main body is secured thereto, said main body has a first elongated portion configured to provide a height and a longitudinal axis that defines a first longitudinal smoking product holder axis, and a second portion having a longitudinal axis that defines a second longitudinal smoking product axis, said second portion having a bottom wall, a top open portion, and a continuous side wall which extends from said bottom wall to said open end, said continuous side wall extending around and fully enclosing said bottom wall to form an interior region, said second portion interior region is configured to receive and hold at least a portion of said smoking product therein said second portion interior region extends away from said first longitudinal smoking product holder axis and is orientated at an angle greater than 0 degrees and less than 90 degrees relative to said first longitudinal smoking product holder axis, wherein when said smoking product inserted into said second portion, said smoking product is maintained above said surface secured thereto and at an angle greater than 0 degrees and less than 90 degrees from said first longitudinal smoking product holder axis and said surface; and a securing member configured to be inserted into a golf tee opening associated with a golf cart.

* * * * *